US008201434B2

(12) United States Patent
Kudo

(10) Patent No.: US 8,201,434 B2
(45) Date of Patent: Jun. 19, 2012

(54) METHOD OF FORMING CAM LOBE

(75) Inventor: Masaaki Kudo, Toyohashi (JP)

(73) Assignee: Musashi Seimitsu Industry Co., Ltd., Aichi-Ken (JP)

( * ) Notice: Subject to any disclaimer, the term of this patent is extended or adjusted under 35 U.S.C. 154(b) by 783 days.

(21) Appl. No.: 12/260,463

(22) Filed: Oct. 29, 2008

(65) Prior Publication Data

US 2009/0107201 A1 Apr. 30, 2009

(30) Foreign Application Priority Data

Oct. 29, 2007 (JP) ..... 2007-280280

(51) Int. Cl.
*B21D 22/00* (2006.01)

(52) U.S. Cl. ..... 72/356

(58) Field of Classification Search ..... 72/256, 72/356, 325, 326, 330, 332, 335; 29/888.1
See application file for complete search history.

(56) References Cited

U.S. PATENT DOCUMENTS 5,829,131 A * 11/1998 DeSloover et al. ..... 29/888.1
6,775,908 B2 * 8/2004 Ohara et al. ..... 72/355.6
7,628,129 B2 * 12/2009 Takeshima et al. ..... 72/352

FOREIGN PATENT DOCUMENTS

DE 101 01 934 B4 1/2001
JP 08-090139 4/1996
JP 2006-169961 6/2006

OTHER PUBLICATIONS

Patent Abstract of Japan of JP 08-090139 dated Apr. 9, 1996.
Patent Abstract of Japan of JP 2006-169961 dated Jun. 29, 2006.
Office Action in German Application No. 102008053474.9 Issued Oct. 6, 2011 With Partial Translation.
Patent English Abstract of German Application 10101934B4 Dated Jan. 17, 2001.

* cited by examiner

*Primary Examiner* — Edward Tolan
*Assistant Examiner* — Mohammad I Yusuf
(74) *Attorney, Agent, or Firm* — Ladas & Parry

(57) ABSTRACT

A primary intermediate formed article is formed into a substantially columnar shape. A secondary intermediate formed article is obtained by piercing a preliminary hole in the primary intermediate formed article such that a radial thickness of a prospective cam top part is larger than a radial thickness of a prospective cam base part, and by forming a positioning part. The positioning part is brought into contact with a tertiary intermediate forged article forging die so as to be positioned, and the secondary intermediate formed article is pressed and forged to form a tertiary intermediate forged article including a cam top, a cam base, and a deformed hole formed by deforming the preliminary hole. A finished cam lobe is obtained by piercing, in an area including the deformed hole.

5 Claims, 7 Drawing Sheets

METHOD OF FORMING CAM LOBE

FIELD OF THE INVENTION

The present invention relates to a method of forming a cam lobe of a cam shaft, which is for example used in an engine of an automobile.

BACKGROUND ART

In a conventional method of forming a cam lobe, a substantially columnar blank is axially pressed by hot forging, so that a barrel-shaped primary intermediate forged article is formed. Then, a preliminary hole, which has a substantially circular sectional shape that is perpendicular to the shaft line, is punched out in a shaft center of the primary intermediate forged article, so that a secondary intermediate forged article is formed. Thereafter, a plug is pressed into the preliminary hole of the secondary intermediate forged article to fill the preliminary hole. The secondary intermediate forged article is again hot-forged, and a tertiary intermediate forged article that is close to a finished cam lobe is formed. Following thereto, the plug is drawn out from the tertiary intermediate forged article, so that a finished cam-lobe hole is formed. A desired cam-lobe contour is finished by cutting, whereby the finished cam lobe is formed (see, JP8-90139A (Patent Document 1)).

In another conventional method of forming a cam lobe, a substantially columnar blank is axially pressed by cold forging, so that an intermediate forged cam lobe having a burr on a contour thereof is formed. Then, a preliminary hole, which has a substantially circular sectional shape that is perpendicular to the shaft line, is punched out in a shaft center of the intermediate forged cam lobe. At the same time, the burr on the outer circumference of the intermediate forged cam lobe is punched out. In addition, the outer circumference of the intermediate forged cam lobe is further forged, so that an excess material extends into the preliminary hole. After that, a cam-lobe hole, which has a substantially circular sectional shape that is perpendicular to the shaft line of the intermediate forged cam lobe, is punched out in the shaft center of the intermediate forged cam lobe, whereby a finished cam lobe is formed (see, JP2006-169961A (Patent Document 2)).

In the method of forming a cam lobe described in Patent Document 1, the preliminary hold of the secondary intermediate forged article is filled by pressing thereinto a plug, and then the secondary intermediate forged article is further forged. Thus, the blank material cannot flow into the preliminary hole upon the further forging, but flows only along the outer circumference. This invites a high forging load.

On the other hand, in the method of forming a cam lobe described in Patent Document 2, in order to prevent generation of an underfill on the contour of the intermediate forged cam lobe, a large burr is left on the outer circumference of the intermediate forged cam lobe. That is, after the burr has been left on the outer circumference of the intermediate forged cam lobe in a forging-die, the blank material cannot move inside the forging-die, which also invites a high forging load.

SUMMARY OF THE INVENTION

In the method described in Patent Document 1, when the second (further) forging is performed without filling the preliminary hole with a plug, the blank material can flow into the preliminary hole. Thus, the tertiary intermediate forged article can be formed with a lower forging load. However, when the blank material flows into the preliminary hole which has been formed in the shaft center of the primary intermediate forged article, there is a possibility that the blank material can not sufficiently flow toward a cam top projecting outward, which may generate an underfill on the cam top.

Thus, the inventors of the present invention have examined that a preliminary hole is pierced at such a certain position and into such a certain shape that a radial thickness of a prospective cam top part to become a cam top is larger than a radial thickness of a prospective cam base part to become a cam base. In this case, a tertiary intermediate forged article can be formed with a lower forging load. In addition, since a quantity of the blank material flowing toward the cam top is increased, there is no possibility that an underfill is formed on the cam top.

However, there occurs another problem in that it is difficult to precisely position the substantially columnar secondary intermediate forged article, which has the prospective cam top part, the prospective cam base part, and the preliminary hole, in an engraving space of a tertiary-intermediate-forged-article forging die for forging a tertiary intermediate forged article. To be specific, because of an influence of a chuck that holds the secondary intermediate forged article and transfers the same to the tertiary-intermediate-forged-article forging die, the secondary forged article is easily circumferentially rotated, which makes it difficult that the prospective cam top part of the secondary intermediate forged article is precisely positioned in opposition to a cam top forging part of the tertiary-intermediate-forged-article forging die. When this opposed relationship is incorrect, an underfill may be formed on the cam top of the intermediate forged article.

The present invention has been made in view of the above circumstances. The object of the present invention is to provide a method of forming a cam lobe in which a cam lobe can be forged with a lower forging load, while a possibility of formation of an underfill on a cam top can be eliminated.

The present invention is a method of forming a cam lobe, the cam lobe including:

- a cam base having a semicircular outer circumference about a shaft center;
- a cam top having a shape that further projects outward from the outer circumference of the semicircular cam base on a side opposed to the semicircular cam base in relation to the shaft center; and
- a cam-lobe hole that is axially pierced concentrically with the shaft center;

the method comprising:

a first step in which a primary intermediate formed article is formed into a substantially columnar shape;

a second step in which a secondary intermediate formed article is obtained by piercing a preliminary hole in an axial direction of the primary intermediate formed article such that a radial thickness of a prospective cam top part to become a cam top is larger than a radial thickness of a prospective cam base part to become a cam base, and by forming a positioning part on an outer circumference on a side of the prospective cam top part, the positioning part projecting radially outward from an outer circumference of the prospective cam base part;

a third step in which a tertiary intermediate forged article including a cam top, a cam base, and a deformed hole that is deformed from the preliminary hole is obtained by, under a state in which the positioning part of the secondary intermediate formed article is positioned by bringing the positioning part into contact with a tertiary-intermediate-forged-article forging die for forging a tertiary intermediate forged article, axially pressing and forging the secondary intermediate formed article with the use of the tertiary-intermediate-forged-article forging die; and a fourth step in which a finished cam lobe is obtained by piercing, in an area including the deformed hole, a cam-lobe hole that is larger than the deformed hole.

According to the present invention, the preliminary hole is pierced at a certain position into a certain shape such that the radial thickness of the prospective cam top part to become a cam top is larger than the radial thickness of the prospective cam base part to become a cam base, and the subsequent forging is performed without filling the preliminary hole. Thus, a blank material can flow into the preliminary hole, whereby the tertiary intermediate forged article can be forged with a lower forging load. Meanwhile, since a quantity of the blank material flowing toward the cam top can be sufficiently ensured, there is no possibility that an underfill is formed on the cam top.

In addition, according to the present invention, the secondary intermediate formed article is provided with the positioning part that projects radially outward from the outer circumference (base circle) of the prospective cam base part, and the positioning part can be positioned by bringing the positioning part into contact with the tertiary-intermediate-forged-article forging die. Thus, when the tertiary intermediate forged article is forged, the prospective cam top part of the secondary intermediate formed article can be precisely opposed to a cam top forging part of the tertiary-intermediate-forged-article forging die. Therefore, a cam lobe free of underfill on a side of a cam top can be reliably forged.

Due to the advantage of the lower forging load, a tertiary-intermediate-forged-article forging apparatus including the tertiary-intermediate-forged-article forging die can be made smaller. Thus, a manufacturing cost can be remarkably reduced.

Preferably, the positioning part of the secondary intermediate formed article conforms to a part of an outer circumferential shape of the tertiary intermediate forged article. In this case, a moving quantity of the blank material during the forging of the tertiary intermediate forged article can be reduced, whereby the forging load can be further lowered.

In addition, preferably, before the fourth step, there is performed a sizing step in which the tertiary intermediate forged article is subjected to a sizing process so as to obtain a quaternary intermediate sized article having a cam-lobe outer circumferential surface of a lower surface roughness. In this case, a step in which the cam-lobe outer circumferential surface is further machined and polished, can be omitted. Thus, the total process cost can be significantly reduced. Simultaneously, the sizing process of the cam-lobe outer circumferential surface provides another advantage in that fluctuations of a cam profile in relation to a reference value can be restrained, as compared with a case in which the cam-lobe outer circumferential surface is polished.

In addition, for example, a sectional shape of the preliminary hole is a partially missing circular shape. In this case, a material quantity required for the prospective cam top part can be easily ensured. In particular, when a diameter of the preliminary hole is designed to be larger and also the missing part is designed to be larger (for example, a larger half-moon shape), a larger quantity of material can flow into the preliminary hole when the tertiary intermediate forged article is forged. In this case, the forging load can be further lowered.

Alternatively, for example, a sectional shape of the preliminary hole is a circular shape; and the preliminary hole is pierced at a position displaced from a shaft center. Also in this case, a material quantity required for the prospective cam top part can be easily ensured.

BRIEF DESCRIPTION OF THE DRAWINGS

FIGS. 1A to 1J are views for explaining a first embodiment of the present invention, in which FIGS. 1A and 1B are a sectional view and a plan view of a primary intermediate formed article in this embodiment, FIGS. 1C and 1D are a sectional view and a plan view of a secondary intermediate formed article in this embodiment, FIGS. 1E and 1F are a sectional view and a plan view of a tertiary intermediate forged article in this embodiment, FIGS. 1G and 1H are a sectional view and a plan view of a quaternary intermediate sized article in this embodiment, and FIGS. 1I and 1J are a sectional view and a plan view of a finished cam lobe that is formed according to this embodiment.

FIGS. 7A to 7J are views for explaining a second embodiment of the present invention, in which FIGS. 7A and 7B are a sectional view and a plan view of a primary intermediate formed article in this embodiment, FIGS. 7C and 7D are a sectional view and a plan view of a secondary intermediate formed article in this embodiment, FIGS. 7E and 7F are a sectional view and a plan view of a tertiary intermediate forged article in this embodiment, FIGS. 7G and 7H are a sectional view and a plan view of a quaternary intermediate sized article in this embodiment, and FIGS. 7I and 7J are a sectional view and a plan view of a finished cam lobe that is formed according to this embodiment.

BEST MODE FOR CARRYING OUT THE PRESENT INVENTION

Figure 1A:
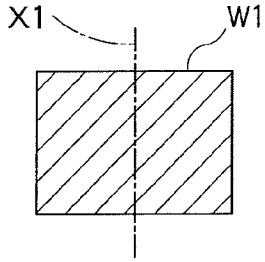
Figure 1B:
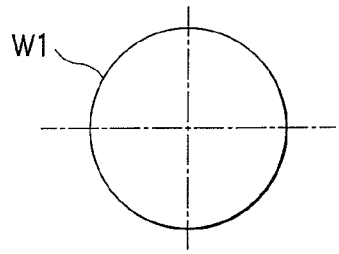
Figure 1C:
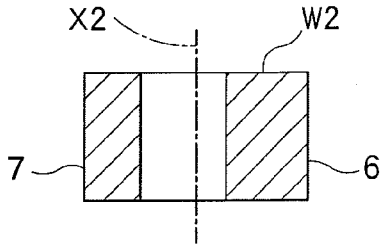
Figure 1D:
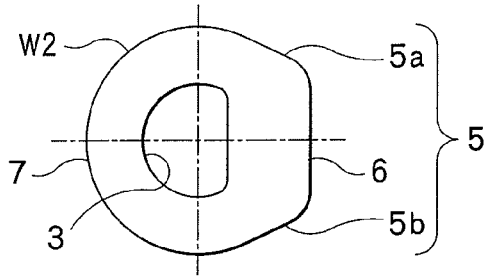
Figure 1E:
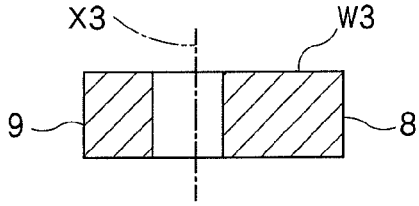
Figure 1F:
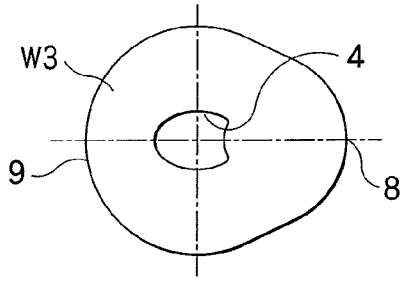
Figure 1G:
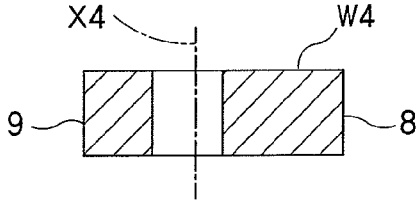
Figure 1H:
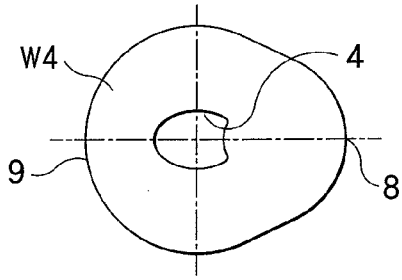
Figure 1I:
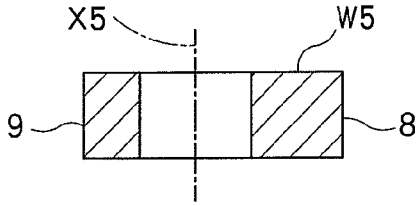
Figure 1J:
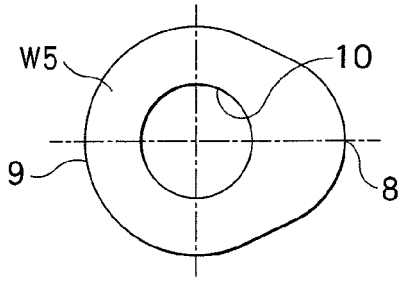

Embodiments of the present invention will be described in detail below with reference to the drawings. FIGS. 1A to 1J are views for explaining a first embodiment of the present invention. FIGS. 1A and 1B are a sectional view and a plan view of a primary intermediate formed article in this embodiment. FIGS. 1C and 1D are a sectional view and a plan view of a secondary intermediate formed article in this embodiment. FIGS. 1E and 1F are a sectional view and a plan view of a tertiary intermediate forged article in this embodiment. FIGS. 1G and 1H are a sectional view and a plan view of a quaternary intermediate formed (sized) article in this embodiment. FIGS. 1I and 1J are a sectional view and a plan view of a finished cam lobe that is formed according to this embodiment.

In the first place, in the first embodiment of the present invention, a change (transition) of shape from a primary intermediate formed article W1 to a finished cam lobe W5 is described.

As shown in FIGS. 1A and 1B, a primary intermediate formed article W1 has a columnar shape.

As shown in FIGS. 1C and 1D, in a secondary intermediate formed article W2, a preliminary hole 3 is pierced in an area including a shaft center X2 of the secondary intermediate article W2 in a direction of the shaft line X2. A center of the preliminary hole 3 conforms to the shaft line X2. A sectional shape of the preliminary hole 3 that is perpendicular to the shaft line X2 is not a complete circular shape but a partially missing circular shape. Due to the adoption of the partially missing circular shape, a radial thickness of a prospective cam top part 6 to become a cam top 8 is larger than a radial thickness of a prospective cam base part 7 to become a cam base 9. In addition, formed on an outer circumference on a side of the prospective cam top part 6 are a first positioning part 5*a* and a second positioning part 5*b* (positioning part 5) that project radially outward from an outer circumference (base circle) of the prospective cam base part 7.

As shown in FIGS. 1E and 1F, an outer contour of a tertiary intermediate forged article W3 is substantially the same as an outer contour of a finished cam lobe W5, which is described below. Namely, the outer contour of the tertiary intermediate forged article W3 includes the semicircular cam base 9, and the cam top 8 that further projects outward from an outer circumference (base circle) of the cam base 9 on a side opposed to the cam base 9 with respect to the shaft center. In an area including a shaft center X3 of the tertiary intermediate forged article W3, a deformed hole 4 is formed in a direction of the shaft line X3. The deformed hole 4 is formed by deforming the preliminary hole 3. A sectional shape of the deformed hole 4 that is perpendicular to the shaft lie X3 is a substantially elliptic shape a part of which is missing.

As shown in FIGS. 1G and 1H, an outer contour of a quaternary intermediate formed article W4 is completely the same as that of the finished cam lobe W5. Namely, a surface roughness of an outer circumferential surface of the quaternary intermediate formed article W4 is lower than a surface roughness of an outer circumferential surface of the tertiary intermediate forged article W3.

As shown in FIGS. 1I and 1J, the finished cam lobe W5 has a cam-lobe hole 10 which is pierced in an area including a shaft center X5 in a direction of the shaft line X5. A sectional shape of the cam-lobe hole 10 that is perpendicular to the shaft line X5 is a complete circular shape. A diameter of the cam-lobe hole 10 is larger than that of the deformed hole 4 of the quaternary intermediate formed article W4.

Next, a secondary-intermediate-formed-article forming (forging) apparatus 11 for forming (forging) the secondary intermediate formed article W2, a tertiary-intermediate-forged-article forging apparatus 31 for forging the tertiary intermediate forged article W3, and a quaternary-intermediate-formed-article forming apparatus 51 for forming the quaternary intermediate formed article W4, are respectively described with reference to FIGS. 2 to 4.

Figure 2:
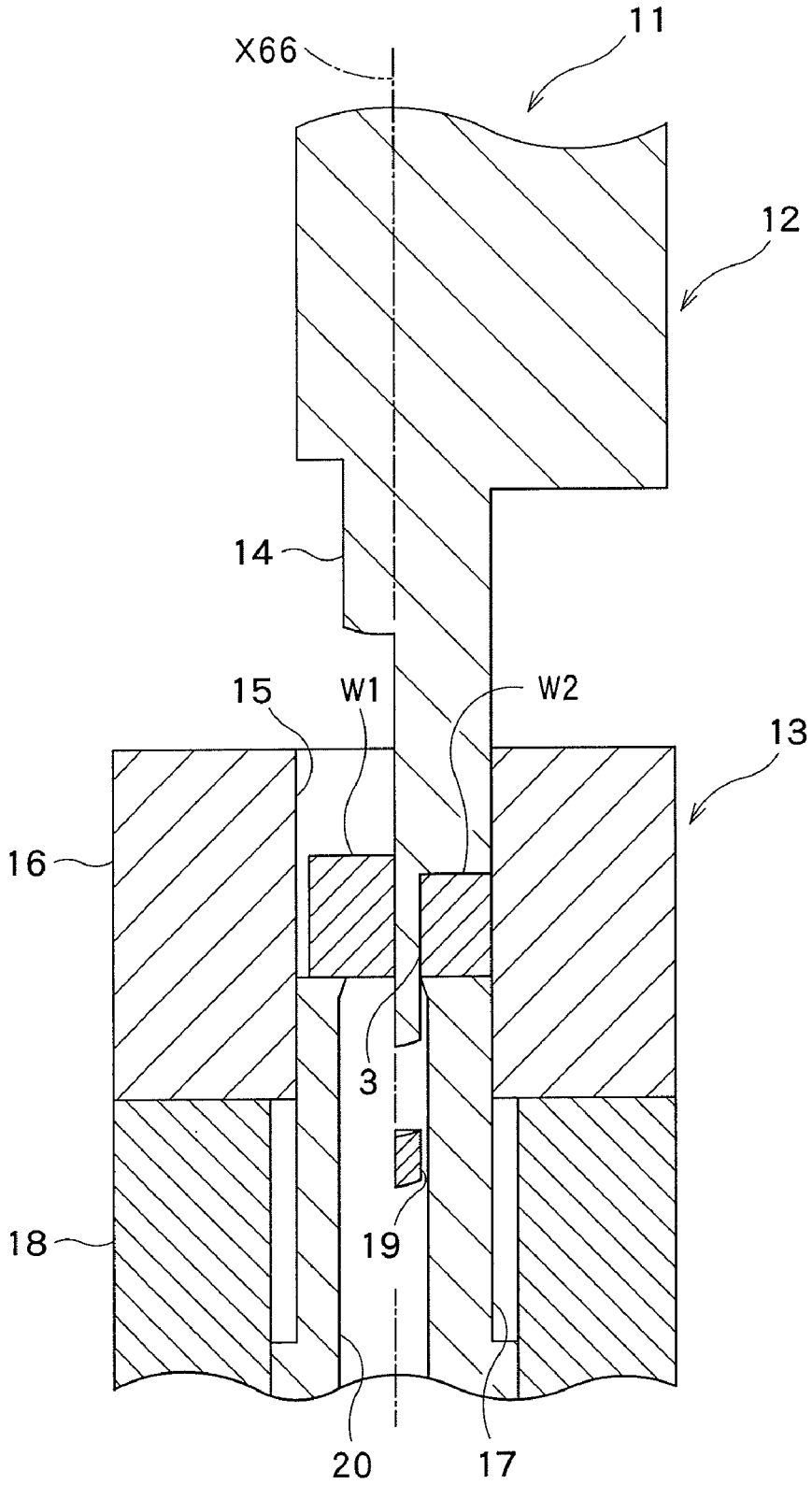
FIG. 2 is a view for explaining a cold forging step for forming the secondary intermediate formed article in the first embodiment of the present invention, in which a left half section is a sectional view showing a state of the prospective secondary intermediate formed article before forged, and a right half section is a sectional view showing a state of the secondary intermediate formed article after forged.

The secondary-intermediate-formed-article forming apparatus 11 shown in FIG. 2 is composed of a first movable mold 12 and a first fixed mold 13.

The first movable mold 12 includes a piercing punch 14 that pierces the preliminary hole 3 in the primary intermediate formed article W1 to form the secondary intermediate formed article W2. The first fixed mold 13 includes: a secondary-intermediate-formed-article forging die 16 that defines a first engraving space 15 in which the secondary intermediate formed article W2 is forged; a first knockout 17 that is disposed on a shaft center part of the secondary-intermediate-formed-article forging die 16 to constitute a part of the first engraving space 15, and that is capable of extruding the secondary intermediate formed (forged) article W2 from the secondary-intermediate-formed-article forging die 16 to the outside; and a first knockout holder 18 that is capable of movably holding the first knockout 17. In the first knockout 17, there is located a discharge channel 20, through which an excess material 19, which is generated when the preliminary hole 3 is pierced, is discharged outside the secondary-intermediate-formed-article forming apparatus 11.

In order that the radial thickness of the prospective cam top part 6 of the secondary intermediate formed article W2 is larger than the radial thickness of the prospective cam base part 7, a sectional shape of the piercing punch 14 that is perpendicular to a shaft line X12 is a partially missing circular shape.

Figure 3:
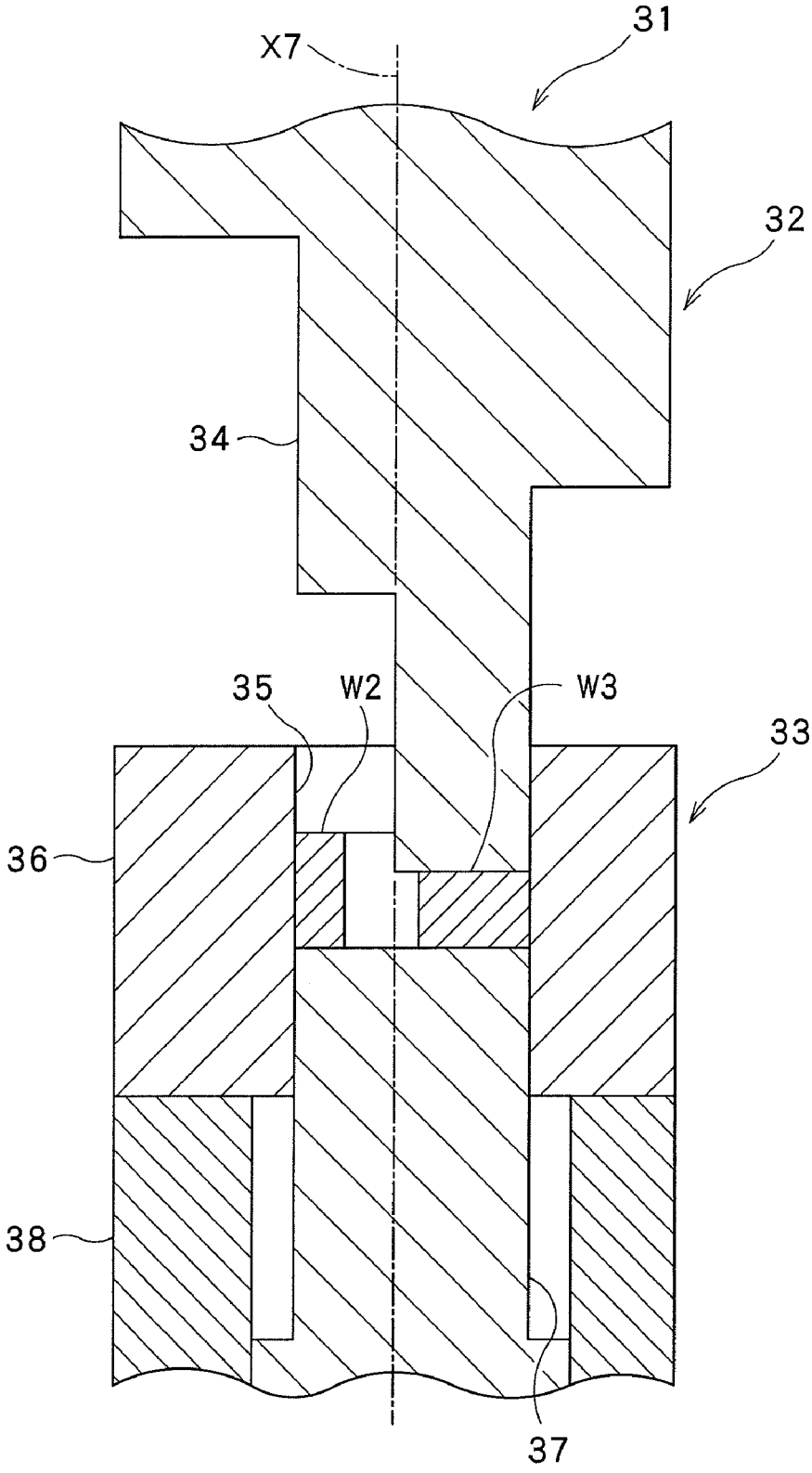
FIG. 3 is a view for explaining a cold forging step for forging the tertiary intermediate forged article in the first embodiment of the present invention, in which a left half section is a sectional view showing a state of the prospective tertiary intermediate forged article before forged, and a right half section is a sectional view showing a state of the tertiary intermediate forged article after forged.

The tertiary-intermediate-forged-article forging apparatus 31 shown in FIG. 3 is composed of a second movable mold 32 and a second fixed mold 33. The second movable mold 32 includes a second punch 34. The second fixed mold 33 includes: a tertiary-intermediate-forged-article forging die 36 that defines a second engraving space 35 in which the tertiary intermediate forged article W3 is forged; a second knockout 37 that is disposed on a shaft center part of the tertiary-intermediate-forged-article forging die 36 to constitute a part of the second engraving space 35, and that is capable of extruding the tertiary intermediate forged article W3 from the tertiary-intermediate-forged-article forging die 36 to the outside; and a second knockout holder 38 that is capable of movably holding the second knockout 37.

Figure 4:
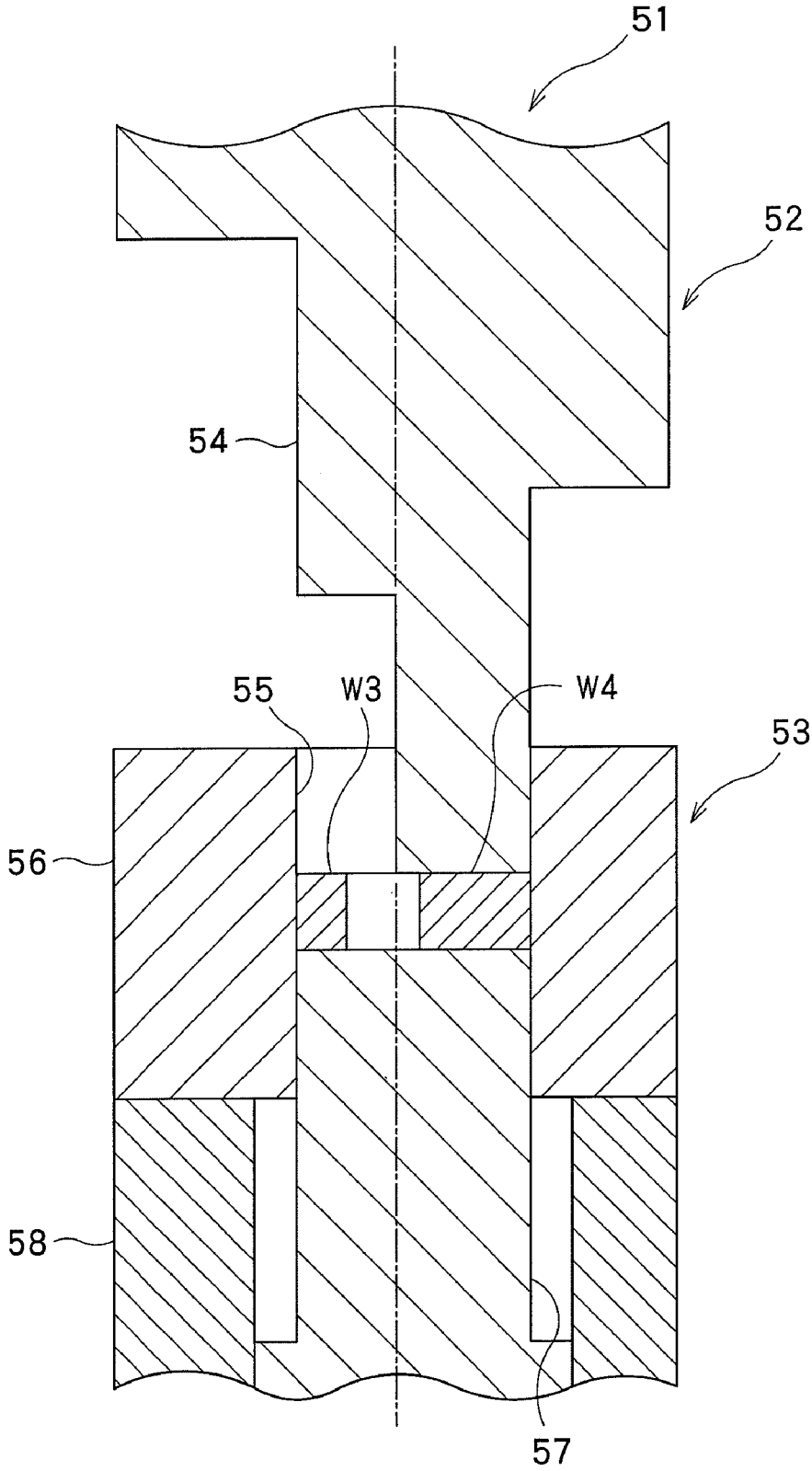
FIG. 4 is a view for explaining a cold forging step for forming (sizing) the quaternary intermediate formed article in the first embodiment of the present invention, in which a left half section is a sectional view showing a state of the prospective quaternary intermediate formed article before forged, and a right half section is a sectional view showing a state of the quaternary intermediate formed article after forged.

The quaternary-intermediate-formed-article forming apparatus 51 shown in FIG. 4 is composed of a third movable mold 52 and a third fixed mold 53. The third movable mold 52 includes a third punch 54. The third fixed mold 53 includes: a quaternary-intermediate-formed-article forging die 56 that defines a third engraving space 55 in which the tertiary intermediate forged article W3 is sized so as to become the quaternary intermediate formed (sized) article W4; a third knockout 57 that is disposed on a shaft center part of the quaternary-intermediate-formed-article forging die 56 to constitute a part of the third engraving space 55, and that is capable of extruding the quaternary intermediate formed article W4 from the quaternary-intermediate-formed-article forging die 56 to the outside; and a third knockout holder 58 that is capable of movably holding the third knockout 57.

Next, the secondary-intermediate-formed-article forging die 16 for forging the secondary intermediate formed article W2, and the tertiary-intermediate-forged-article forging die 36 for forging the tertiary intermediate forged article W3 are respectively described with reference to FIGS. 5A to 6B.

Figure 5A:
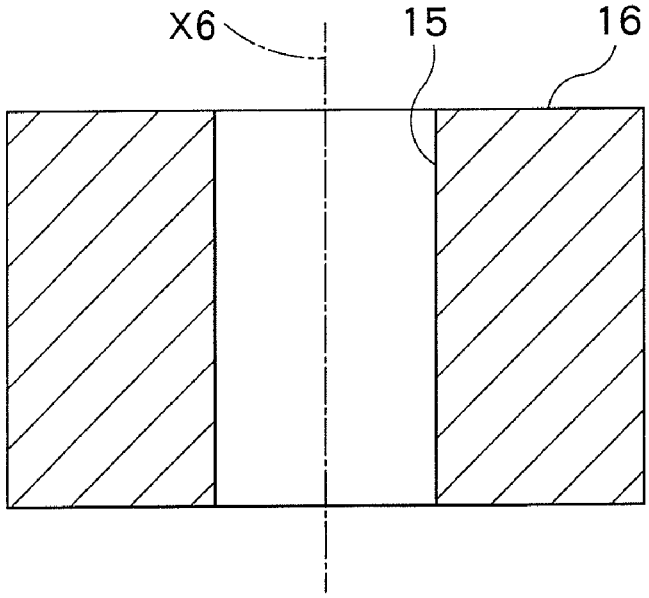
FIGS. 5A and 5B are a sectional view and a plan view of a secondary-intermediate-formed-article forging die to be used in the first embodiment of the present invention.
Figure 5B:
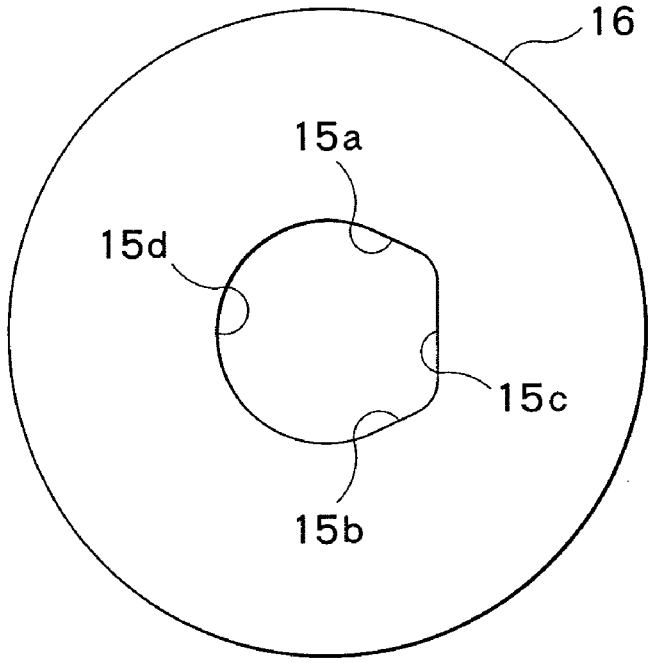

As shown in FIG. 5A, the secondary-intermediate-formed-article forging die 16 has the first engraving space 15 in which the secondary intermediate formed article W2 is forged, the first engraving space 15 extending in a direction of a shaft line X6. More specifically, as shown in FIG. 5B, there are a prospective-cam-top-part forging part 15*c* for forging the prospective cam top part 6 of the secondary intermediate formed article W2, and a prospective-cam-base-part forging part 15*d* for forging the prospective cam base part 7 of the secondary intermediate formed article W2. In addition, between the prospective-cam-top-part forging part 15*c* and the prospective-cam-base-part forging part 15*d*, there are a first-positioning-part forging part 15*a* and a second-positioning-part forging part 15*b* that project radially outward from a base circle of the prospective-cam-base-part forging part 15*d*. The first-positioning-part forging part 15*a* and the second-positioning-part forging part 15*b* are parts for forging the first positioning part 5*a* and the second positioning part 5*b* in the secondary intermediate formed article W2.

Figure 6A:
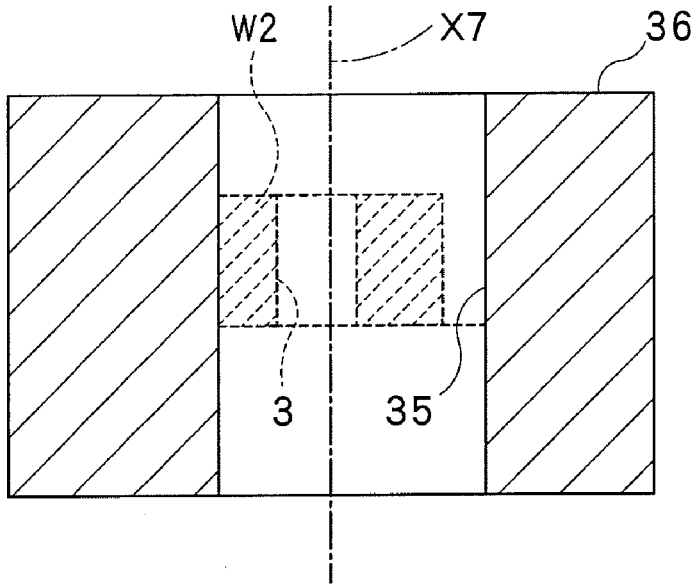
FIGS. 6A and 6B are a sectional view and a plan view of a tertiary-intermediate-forged-article forging die to be used in the first embodiment of the present invention and the secondary intermediate formed article positioned in an engraving space of the tertiary-intermediate-forged-article forging die.
Figure 6B:
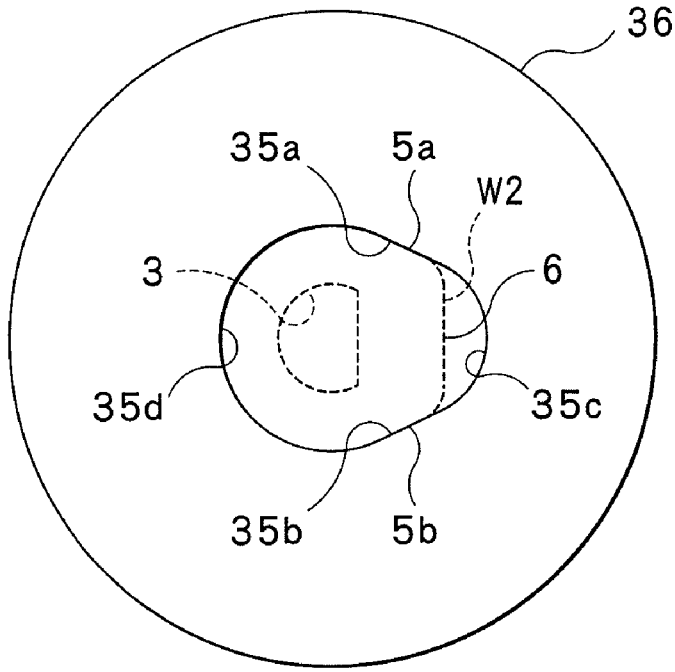

As shown in FIG. 6A, the tertiary-intermediate-forged-article forging die 36 has the second engraving space 35 in which the tertiary intermediate forged article W3 is forged, the second engraving space 35 extending in a direction of a shaft line X7. More specifically, as shown in FIG. 6B, there are a cam-top forging part 35*c* for forging the cam top 8 of the tertiary intermediate forged article W3, and a cam-base forging part 35*d* for forging the cam base 9 of the tertiary intermediate forged article W3. In addition, between the cam-top forging part 35*c* and the cam-base forging part 35*d*, there are a first-positioning-part contact part 35*a* and the second-positioning-part contact part 35*b* that project radially outward from a base circle of the cam-base forging part 35*d*.

The first-positioning-part contact part 35*a* and the second-positioning-part contact part 35*a* are parts with which the first positioning part 5*a* and the second positioning part 5*b* of the secondary intermediate formed article W2 are respectively brought into contact so as to be positioned.

Next, steps of forming the cam lobe W5 from the columnar primary intermediate formed article W1 are sequentially described.

At first, a columnar blank W0, which is obtained by cutting a wire rod at a required length, is subjected to a necessary process such as a shot/bonderizing process. Thus, as shown in FIGS. 1A and 1B, the primary intermediate formed article W1 is formed.

Then, as shown in the left half section of FIG. 2, the primary intermediate formed article W1 is placed into the first engraving space 15 of the secondary-intermediate-formed-article forging die 16 of the secondary-intermediate-formed-article forming apparatus 11 by a transfer apparatus, not shown. Then, as shown in the right half section of FIG. 2, the piercing punch 14 of the first movable mold 12 is moved downward to punch an excess portion of the material 19 in an area including the shaft center X2, so that the preliminary hole 3 is formed. As shown in FIGS. 1C and 1D, in the secondary intermediate formed article W2 in which the preliminary hole 3 has been pierced, the radial thickness in the prospective cam top part 6 is larger than the radial thickness in the prospective cam base part 7.

Simultaneously with the formation of the preliminary hole 3, the primary intermediate formed article W1 is pressed in a direction of the shaft line X2 so as to be forged into the secondary intermediate formed article W2. As shown in FIG. 5B, the secondary-intermediate-formed-article forging die 16 has the first-positioning-part forging part 15*a* and the second-positioning-part forging part 15*b*, which project radially outward from the base circle of the prospective-cam-base-part forging part 15*d*. Thus, on an outer circumference on the side of the prospective cam top part 6, there are forged the first positioning part 5*a* and the second positioning part 5*b* (positioning part 5) that project radially outward from the base circle of the prospective cam base part 7.

After the forming (forging) of the secondary intermediate formed article W2 has been completed, the piercing punch 14 is moved upward. Thereafter, the first knockout 17 is moved upward, whereby the secondary intermediate formed article W2 is taken out from the secondary-intermediate-formed-article forging die 16.

Following thereto, as shown in the left section of FIG. 3, the secondary intermediate formed article W2 is placed into the second engraving space 35 of the tertiary-intermediate-forged-article forging die 36 of the tertiary-intermediate-forged-article forging apparatus 31 by a transfer apparatus, not shown. As shown in FIG. 6B, since the tertiary-intermediate-forged-article forging die 36 has, between the cam-top forging part 35*c* and the cam-base forging part 35*d*, the first-positioning-part contact part 35*a* and the second-positioning-part contact part 35*b* that project radially outward from the base circle of the cam-base forging part 35*d*. The first positioning part 5*a* of the secondary intermediate formed article W2 is brought into contact with the first-positioning-part contact part 35*a* of the second engraving space 35 so as to be circumferentially positioned, and simultaneously therewith, the second positioning part 5*b* of the secondary intermediate formed article W2 is brought into contact with the second-positioning-part contact part 35*b* of the second engraving space 35 so as to be circumferentially positioned. Therefore, the prospective cam top part 6 of the secondary intermediate formed article W2 and the cam top forging part 35*c* of the tertiary-intermediate-forged-article forging die 36 can be precisely opposed to each other.

Subsequently, as shown in the right half section of FIG. 3, the second punch 34 of the second movable mold 32 is moved downward to press the secondary intermediate formed article W2 in a direction of the shaft line X2. Thus, an excess blank material moves (flows) toward the cam top forging part 35*c* of the tertiary-intermediate-forged-article forging die 36, and toward (into) the preliminary hole 3 of the secondary intermediate formed article W2. Then, as shown in FIGS. 1E and 1F, there is formed the tertiary intermediate forged article W3 which includes: on an outer circumference thereof, the semi-circular cam base 9 and the cam top 8 that further projects outward from the base circle of the cam base 9 on a side opposed to the cam base 9; and the deformed hole 4 in an area including the shaft center X3, the deformed hole 4 having been formed by deforming and narrowing the preliminary hole 3.

After the forming (forging) of the tertiary intermediate formed article W3 has been completed, the second punch 34 is moved upward. Thereafter, the second knockout 37 is moved upward, whereby the tertiary intermediate formed article W3 is taken out from the tertiary-intermediate-formed-article forging die 36.

Following thereto, as shown in the left half section of FIG. 4, the tertiary intermediate forged article W3 is placed into the third engraving space 55 of the quaternary-intermediate-formed-article forming (sizing) die 56 of the quaternary-intermediate-formed-article forming apparatus 51 by a transfer apparatus, not shown.

Then, as shown in the right half section of FIG. 4, the third punch 54 of the third movable mold 52 is moved downward to press the tertiary intermediate forged article W3 in a direction of the shaft line X3. Thus, the tertiary intermediate forged article W3 is subjected to a sizing process, and there is obtained the quaternary intermediate formed article W4 whose contour is finished with a desired dimensional accuracy.

After the forming (sizing) of the quaternary intermediate formed article W4 has been completed, the third punch 54 is moved upward. Thereafter, the third knockout 57 is moved upward whereby the quaternary intermediate forged article W4 is taken out from the quaternary-intermediate-formed-article forming die 56.

Following thereto, the quaternary intermediate formed article W4 is placed into a cam-lobe forming apparatus, not shown, by a transfer apparatus, not shown. Then, a cam-lobe hole 10 larger than the deformed hole 4 is formed by a machining process in an area including the deformed hole 4 (area including the shaft center X5), and thus the finished cam lobe W5 is obtained.

According to the method of forming a cam lobe in this embodiment, the preliminary hole 3 is pierced at a certain position into a certain shape such that the radial thickness of the prospective cam top part 6 to become the cam top 8 is larger than the radial thickness of the prospective cam base part 7 to become the cam base 9, and the subsequent forging is performed without blocking (filling) the preliminary hole 3. Thus, the tertiary intermediate forged article W3 can be forged while allowing the blank material to move into the preliminary hole 3, i.e., the tertiary intermediate forged article W3 can be forged with a lower forging load. At the same time, since a quantity of the blank material flowing (moving) toward the cam top is sufficiently ensured, there is no possibility that an underfill is formed on the cam top.

In addition, the secondary intermediate formed article W2 is provided with the positioning part 5 (5*a* and 5*b*) that projects radially outward from the outer circumference (base circle) of the prospective cam base part 7, and the positioning part 5 can be positioned by bringing the positioning part 5 into contact with the tertiary-intermediate-forged-article forging die 36. Thus, when the tertiary intermediate forged article W3 is forged, the prospective cam top part 6 of the secondary intermediate formed article W2 can be precisely opposed to the cam-top forging part 35*c* of the tertiary-intermediate-forged-article forging die 36. Therefore, a cam lobe free of underfill on a side of a cam top can be reliably formed.

Further, the positing part 5 of the secondary intermediate formed article W2 conforms to a part of the outer contour of the tertiary intermediate forged article W3. Thus, a moving quantity of the blank material during the forging of the tertiary intermediate forged article W3 can be reduced, whereby the forging load is further lowered.

Furthermore, there is performed a sizing step in which the tertiary intermediate forged article W3 is subjected to a sizing process so as to obtain the quaternary intermediate sized article W4 having a cam-lobe outer circumferential surface of a lower surface roughness. Owing to this process, another step in which the cam-lobe outer circumferential surface is further machined and polished, can be omitted. Thus, the total process cost can be significantly reduced. Simultaneously, the sizing step of the cam-lobe outer circumferential surface provides another advantage in that fluctuations of a cam profile in relation to a reference value can be restrained, as compared with a case in which the cam-lobe outer circumferential surface is polished. Specifically, fluctuations of the cam profile in relation to a reference value can be reduced to half or more.

Moreover, since the sectional shape of the preliminary hole 3 is the partially missing circle shape, a material quantity required for the prospective cam top part 6 can be relatively easily ensured. In particular, when a diameter of the preliminary hole 3 is designed to be larger and also the missing part is designed to be larger (for example, a larger half-moon shape), a larger quantity of material can flow into the preliminary hole 3 when the tertiary intermediate forged article W3 is forged. In this case, the forging load can be further lowered.

Figure 7A:
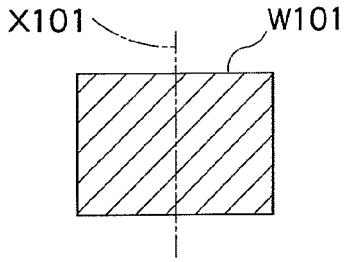
Figure 7B:
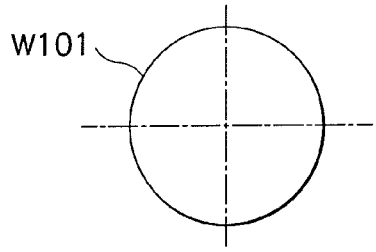
Figure 7C:
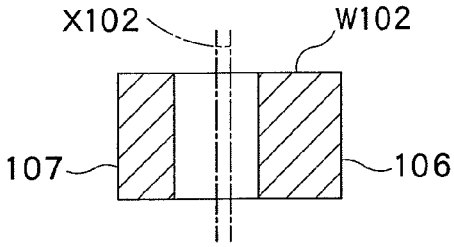
Figure 7D:
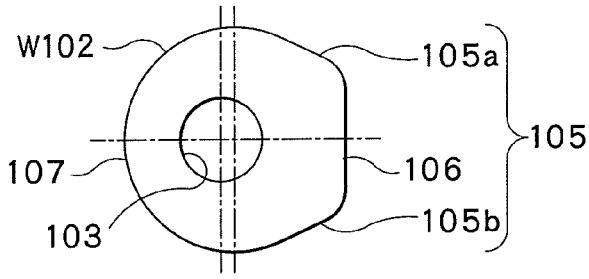
Figure 7E:
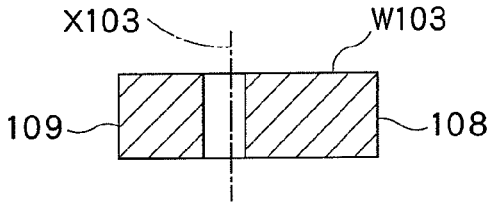
Figure 7F:
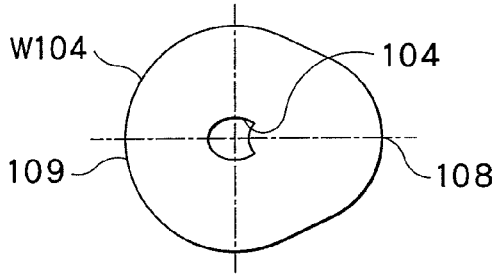
Figure 7G:
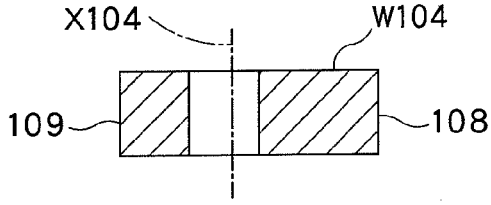
Figure 7H:
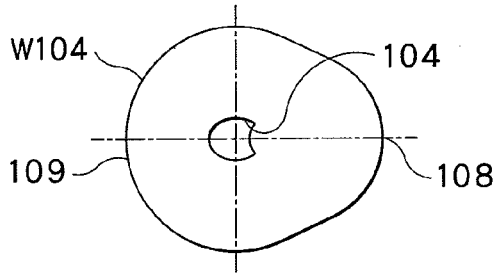
Figure 7I:
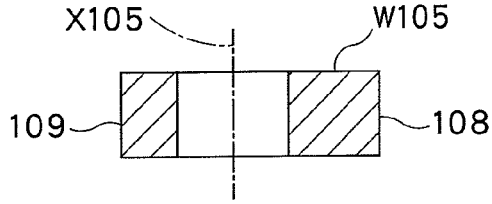
Figure 7J:
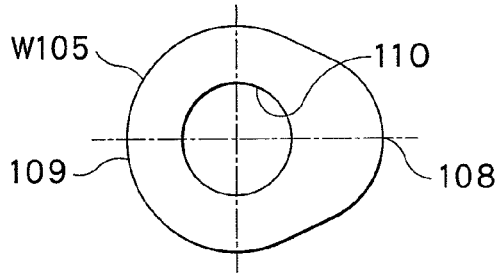

Next, a second embodiment of the present invention is described. FIGS. 7A to 7J are views for explaining a second embodiment of the present invention. FIGS. 7A and 7B are a sectional view and a plan view of a primary intermediate formed article in this embodiment. FIGS. 7C and 7D are a sectional view and a plan view of a secondary intermediate formed article in this embodiment. FIGS. 7E and 7F are a sectional view and a plan view of a tertiary intermediate forged article in this embodiment. FIGS. 7G and 7H are a sectional view and a plan view of a quaternary intermediate formed (sized) article in this embodiment. FIGS. 7I and 7J are a sectional view and a plan view of a finished cam lobe that is formed according to this embodiment.

At first, as shown in FIGS. 7A and 7B, a columnar primary intermediate formed article W101 is formed, which is similar to the first embodiment.

Then, as shown in FIGS. 7C and 7D, a preliminary hole 103 is formed at a position eccentric from a shaft center X102 of the primary intermediate formed article W101. The preliminary hole 103 is pierced in a direction of the shaft line X102, with a center of the preliminary hole 103 being displaced from the shaft line X102. A sectional shape of the preliminary hole 103 that is perpendicular to the shaft line X102 is a complete circular shape. However, a diameter of the preliminary hole 103 is smaller than that of the preliminary hole 3 in the first embodiment. Due to the preliminary hole 103, a radial thickness of a prospective cam top part 106 to become a cam top 108 is larger than a radial thickness of a prospective cam base part 107 to become a cam base 109. Simultaneously with the formation of the preliminary hole 103, on an outer circumference on a side of the prospective cam top part 106, there are formed a first positioning part 105*a* and a second positioning part 105*b* (positioning part 105) that project radially outward from an outer circumference (base circle) of the prospective cam base part 107. Thus, a secondary intermediate formed article W102 is obtained.

Following thereto, the secondary intermediate formed article W102 is pressed so that a tertiary intermediate forged article W103 is forged. As shown in FIGS. 7E and 7F, the tertiary intermediate forged article W103 includes a cam base 109 of a semicircular (half-moon) shape, and a cam top 108 that projects further outward from an outer circumference (base circle) of the cam base 109 on a side opposed to the cam base 109 with respect to a shaft center X103. In addition, in an area including the shaft center X103 of the tertiary intermediate forged article W3, a deformed hole 104 is axially pierced. The deformed hole 104 is formed by compressing and deforming the preliminary hole 103.

Thereafter, the tertiary intermediate forged article W103 is subjected to a sizing process, and thus a quaternary intermediate sized article W104 is obtained. As shown in FIGS. 7G and 7H, the quaternary intermediate sized article W104 includes the cam base 109 and the cam top 108 that are finished at the same surface roughness as that of an outer circumference of a finished cam lobe W 105.

Finally, a cam-lobe hole 110 is formed by machining in an area including a shaft center X104 of the quaternary intermediate sized article W104. Thus, as shown in FIGS. 7I and 7J, the finished cam lobe W105 is obtained.

Although the preliminary holes 3 and 103 of the secondary intermediate formed articles W2 and W102 in the aforementioned respective embodiments are formed in one forging step, the preliminary holes 3 and 103 may be formed in a plurality of forging steps.

In the aforementioned respective embodiments, the pressing (forging) process is performed while the material is made to flow into the preliminary holes 3 and 103. Namely, the tertiary intermediate forged articles W3 and W103 are forged by cold forging because the forging load is low. However, it is possible to employ a warm forging in which an article is heated at a temperature of from 600° C. to 900° C., or a hot forging in which an article is heated at a temperature higher than the above range. That is, the primary intermediate formed article W1, the secondary intermediate formed article W2, the tertiary intermediate forged article W3, and the quaternary intermediate formed article W4, may be respectively formed by any of the cold forging, the warm forging, and the hot forging.

As long as the radial thickness of the prospective cam top part is larger than the radial thickness of the prospective cam base part, a shape of the preliminary hole in the secondary intermediate formed article is not particularly limited (for example, a polygonal shape is possible).

In addition, in the secondary-intermediate-formed-article forming apparatus 11, the tertiary-intermediate-forged-article forging apparatus 31, and the quaternary-intermediate-formed-article forming apparatus 51, which have been described in the above respective embodiments, although the movable molds 12, 32, 52 and the fixed molds 13, 33, 53 are respectively arranged vertically, the movable molds 12, 32, 52 and the fixed molds 13, 33, 53 may be arranged horizontally. Alternatively, each of the movable molds 12, 32, 52 and the fixed molds 13, 33, 53 of the respective secondary-intermediate-formed-article forming apparatus 11, the tertiary-intermediate-forged-article forming apparatus 31, and the quaternary-intermediate-formed-article forming apparatus 51, may be constituted by assembling a plurality of dividable mold elements.

What is claimed is:

1. A method of forming a cam lobe, the cam lobe including:

a cam base (9, 109) having a semicircular outer circumference about a shaft center (X5, X105);

a cam top (8, 108) having a shape that further projects outward from the outer circumference of the semicircular cam base (9, 109) on a side opposed to the semicircular cam base (9, 109) in relation to the shaft center (X5, X105); and a cam-lobe hole (10, 110) that is axially pierced concentrically with the shaft center (X5, X105);

the method comprising:

a first step in which a primary intermediate formed article (W1, W101) is formed into a substantially columnar shape;

a second step in which a secondary intermediate formed article (W2, W102) is obtained by piercing a preliminary hole (3, 103) through the primary intermediate formed article (W1, W101) in an axial direction of the primary intermediate formed article (W1, W101) such that a radial thickness of a prospective cam top part (6, 106) to become a cam top (8, 108) is larger than a radial thickness of a prospective cam base part (7, 107) to become a cam base (9, 109), and by forming a positioning part (5, 105) on an outer circumference on a side of the prospective cam top part, the positioning part (5, 105) projecting radially outward from an outer circumference of the prospective cam base part (7, 107);

a third step in which a tertiary intermediate forged article (W3, W103) including a cam top (8, 108), a cam base (9, 109), and a deformed hole (4, 104) that is deformed from the preliminary hole (3, 103) is obtained by, under a state in which the positioning part (5, 105) of the secondary intermediate formed article (W2, W102) is positioned by bringing the positioning part (5, 105) into contact with a tertiary-intermediate-forged-article forging die (36) for forging a tertiary intermediate forged article (W3, W103), axially pressing and forging the secondary intermediate formed article (W2, W102) with the use of the tertiary-intermediate-forged-article forging die (36); and a fourth step in which a finished cam lobe (W5, W105) is obtained by piercing, in an area including the deformed hole (4, 104), a cam-lobe hole (10, 110) that is larger than the deformed hole (4, 104).

2. The method of forming a cam lobe according to claim 1, wherein the positioning part (5, 105) of the secondary intermediate formed article (W2, W102) conforms to a part of an outer circumferential shape of the tertiary intermediate forged article (W3, W103).

3. The method of forming a cam lobe according to claim 1, wherein before the fourth step, there is performed a sizing step in which the tertiary intermediate forged article (W3, W103) is subjected to a sizing process so as to obtain a quaternary intermediate sized article (W4, W104) having a cam-lobe outer circumferential surface of a lower surface roughness.

4. The method of forming a cam lobe according to claim 1, wherein a sectional shape of the preliminary hole (3) is a partially missing circular shape.

5. The method of forming a cam lobe according to claim 1, wherein:

a sectional shape of the preliminary hole (103) is a circular shape; and the preliminary hole (103) is pierced at a position displaced from a shaft center (X102).

* * * * *